US007557075B2

(12) United States Patent
Fregonese et al.

(10) Patent No.: US 7,557,075 B2
(45) Date of Patent: Jul. 7, 2009

(54) WATER SOLUBLE PACKAGES CONTAINING LIQUID COMPOSITIONS

(75) Inventors: Daniele Fregonese, Ludwigshafen (DE); Chris Efstathios Housmekerides, Ludwigshafen (DE)

(73) Assignee: Reckitt Benckiser N.V., WT Hoofddorp (NL)

( * ) Notice: Subject to any disclaimer, the term of this patent is extended or adjusted under 35 U.S.C. 154(b) by 486 days.

(21) Appl. No.: 10/548,714

(22) PCT Filed: Mar. 11, 2004

(86) PCT No.: PCT/GB2004/001045

§ 371 (c)(1),
(2), (4) Date: Oct. 18, 2005

(87) PCT Pub. No.: WO2004/081163

PCT Pub. Date: Sep. 23, 2004

(65) Prior Publication Data

US 2006/0160716 A1 Jul. 20, 2006

(30) Foreign Application Priority Data

Mar. 11, 2003 (GB) ..... 0305493.9

(51) Int. Cl.
*C11D 17/04* (2006.01)

(52) U.S. Cl. ..... 510/296; 510/220; 510/439

(58) Field of Classification Search ..... 510/220, 510/296, 438, 439
See application file for complete search history.

(56) References Cited

U.S. PATENT DOCUMENTS

| | | | | |
|---|---|---|---|---|
| 4,973,416 | A | 11/1990 | Kennedy | |
| 5,213,706 | A | 5/1993 | Rapisarda et al. | |
| 6,958,313 | B2 * | 10/2005 | Caswell et al. | 510/296 |
| 6,998,375 | B2 * | 2/2006 | Kapur et al. | 510/220 |

FOREIGN PATENT DOCUMENTS

| | | | |
|---|---|---|---|
| CA | 1112534 | A | 11/1981 |
| DE | OS 20 29 598 | | 12/1970 |
| EP | 0414462 | A2 | 2/1991 |
| EP | 0852259 | A1 | 7/1998 |
| EP | 1065264 | A1 | 1/2001 |
| GB | 2361687 | A | 10/2001 |
| WO | WO 94/14941 | | 7/1994 |
| WO | WO 98/06813 | A1 | 2/1998 |
| WO | WO 01/36290 | | 5/2001 |
| WO | WO 02/16541 | A | 2/2002 |
| WO | WO 03/010270 | A | 2/2003 |

* cited by examiner

*Primary Examiner*—Lorna M Douyon

(57) ABSTRACT

A package comprises an aqueous liquid detergent composition enclosed by a water-soluble or water-dispersible packaging material. The aqueous liquid detergent composition has a water content of between 20 and 50 wt %. The aqueous liquid detergent composition comprises at least one polyphosphate builder material in an amount of greater than 10 wt % and a carbohydrate.

12 Claims, No Drawings

WATER SOLUBLE PACKAGES CONTAINING LIQUID COMPOSITIONS

The present invention relates to a package comprising a detergent composition as well as to a process for preparing such a package.

It is known to package detergents or related materials such as water-softeners in containers or sachets of water-soluble or water-dispersible film material, in particular to avoid direct contact of the hazardous or irritant material with the consumers' skin. Moreover, dosage is easier with packaged material, and it can simply be added to water to release the contents of the container or sachet into the water during usage.

Although a large number of aqueous liquid detergent compositions, mostly in gel form, for use in automatic dishwashers or for laundry, have been described in the prior art, such as in U.S. Pat. Nos. 4,973,416 and 5,213,706, WO 94/14941 or DE-OS 20 29 598, none of those compositions has been proposed for being packaged in water-soluble or water-dispersible film material.

CA-A-1,112,534 discloses a package made of water-soluble material in film form enclosing within it a paste-form, automatic dishwasher-compatible detergent composition. Detergent compositions described in this document are, for example, based on sodium tripolyphosphate.

For manufacturing portioned packages of the material, it is desired to obtain a highly concentrated liquid composition. Disadvantageously this normally results in a unstable product composition due to long-term weight variation by gain or loss of free water. In particular, for transparent products, such weight variation is detrimental for the appearance as it causes occurrence of turbidity or crystallization of the product. This is a particularly acute problem for ionic components of the liquid, especially builders such as tripolyphosphates.

The present invention seeks to provide for a detergent product comprising an aqueous liquid detergent composition packaged in a water-soluble or water-dispersible packaging and having an improved stability as to long-term weight variation.

The present invention provides a package comprising an aqueous liquid detergent composition enclosed by a water-soluble or water-dispersible packaging material, said aqueous liquid detergent composition having a water content of between 20 and 50 wt %, and comprising at least one polyphosphate builder material, in an amount of greater than 10 wt % and a carbohydrate.

We have now surprisingly discovered that an aqueous liquid detergent composition enclosed by a water-soluble or water-dispersible packaging, said detergent composition having a water content of between 20 and 50 wt %, containing at least one polyphosphate builder in an amount of greater than 10 wt % and a carbohydrate shows good stability. This stability is characterised by elimination of turbidity/clouding issues even with loss of water from the package. Most surprisingly these issues do not even arise with a complete loss of water content.

Additionally the incorporation of a carbohydrate has been found to overcome stability issues caused by the inclusion of a polymer in the liquid composition. Previously polymers have been found to be either incompatible with liquid detergent compositions or cause the viscosity of the composition to rise to a level unacceptable for industrial processing. Thus with the incorporation of a carbohydrate the detergent composition may comprise one or more polymers (typically based on an acrylate/acrylic acid monomer). The polymers may be used to enhance the detergent action of the composition or the appearance of the package by influencing the viscosity of the detergent composition.

The amount of carbohydrate is preferably up to 40 wt %, more preferably up to 35 wt %, more preferably up to 30 wt % and most preferably up to around 25 wt %. Usually the amount of carbohydrate comprises more than 5 wt %, more preferably more than 10 wt % and most preferably more than 15 wt %. Most preferably the amount of carbohydrate is about 20wt %.

Carbohydrates are usually represented by the generalised formula $C_x(H_2O)_y$. The term carbohydrate as used herein also includes materials which are similar in nature like gluconic acids or amino sugars which cannot be fully represented by said formula. Also other carbohydrate derivatives like sugar alcohols such as sorbitol, glucitol, saccarose, mannitol, galactitol, dulcitol, xylitol and erythritol and other derivatives such as isomaltutose and isomalt can be used in the present invention.

Preferred monosaccharides for use in the invention include glucose, dextrose and fructose.

Preferred oligosaccharides for use in the invention include lactose, sucrose, maltose and dextrins.

Most preferably the carbohydrate comprises sorbitol.

The amount of polyphosphate builder is preferably up to 70 wt %, more preferably up to 65 wt %, more preferably up to 60 wt % and most preferably up to around 55 wt %. Usually the amount of polyphosphate builder comprises more than 10 wt %, more preferably more than 20 wt %, more preferably more than 30 wt % and most preferably more than 40 wt %. Most preferably the amount of polyphosphate builder is from 40-50 wt %.

There is a variety of polyphosphate builder materials appropriate for use in aqueous liquid detergent compositions packaged in accordance with the process of the present invention. The sodium or potassium salts of polyphosphates such as tripolyphosphate, pyrophosphate or metaphosphate are particularly suited in this application. For the present invention, potassium tripolyphosphate is a preferred compound.

Preferably, the water content of the packaged aqueous liquid detergent composition is between 20 and 40 wt %, more preferably between 25 and 35 wt % and most preferably between 25 and 30 wt %.

Preferably the formulation comprises up to 15% by weight of polymer, more preferably the formulation comprises from 1-8% by weight, more preferably from 1-3% and most preferably about 1.5% by weight of the polymer.

Preferably the polymer is a sulphonated polymer. These polymers have been found to display high efficiency in addressing issues caused by hard water deposits (spotting) on items washed in a dishwasher.

The sulphonated polymer preferably comprises a copolymer. Preferably, the copolymer comprises the following monomers:

(I) 50-90% by weight of one or monoethylenically unsaturated $C_3$-$C_6$ monocarboxyic acid;

(II) 10-50% by weight of unsaturated sulphonic acid.

Advantageously, the copolymer comprises:

(I) 60-90% by weight of one or monoethylenically unsaturated $C_3$-$C_6$ monocarboxylic acid;

(II) 10-40% by weight of unsaturated sulphonic acid.

More advantageously the copolymer comprises.

(I) 77% by weight of one or monoethylenically unsaturated $C_3$-$C_6$ monocarboxylic acid (II) 23% by weight of unsaturated sulphonic acid.

The monoethylenically unsaturated $C_3$-$C_6$ monocarboxylic acid is preferably (meth)acrylic acid.

The unsaturated sulphonic acid monomer is preferably one of the following: 2-acrylamido methyl-1-propanesultonic acid, 2-methacrylamido-2-methyl-1-propanesulphonic acid, 3-methacrylamido-2-hydroxypropanesulphonic acid, allysulphonic acid, methallysulphonic acid, allyloxybenzenesulphonic acid, methallyloxybenzensulphonic acid, 2-hydroxy-3-(2-propenyloxy)propanesulphonic acid, 2-methyl-2-propene-1-sulphonic acid, styrene sulphonic acid, vinylsulphonic acid, 3-sulphopropyl acrylate, 3-sulphopropyl methacrylate, sulphomethylacrylamid, sulphomethylmethacrylamide, and water soluble salts thereof.

The unsaturated sulphonic acid monomer is most preferably 2-acrylamido-2-propanesulphonic acid (AMPS).

The weight average molecular weight of the copolymer according to the present invention is from 3,000 to 50,000 and preferably from 4,500 to 35,000.

Commercially available examples of the preferred sulphonated polymer are available from Rohm & Haas under the trade names Acusol 587G and Acusol 588G The liquid composition may comprise a builder of the oligocarboxylate or polycarboxylate type, such as sodium citrate, sodium polyacrylate and its copolymers, sodium gluconate or mixtures thereof. There is an additional benefit of using those materials, as they simultaneously show a co-builder effect, thus supporting the detergency. The amount of this builder is preferably up to 40 wt %, more preferably up to 30 wt %, more preferably up to 20 wt % and most preferably up to 10 wt %.

The packaged aqueous liquid detergent compositions can also optionally comprise one or more additional ingredients. These include conventional detergent composition components, such as surfactants, bleaches, bleach enhancing agents, silver-corrosion inhibiting agents, enzymes, enzyme stabilizers, soil release agents, dye transfer inhibiting agents, brighteners, perfumes, colorants, and dyes.

It was discovered that the inventive packaged aqueous liquid detergent composition was easier to thicken by commonly used thickeners such as polyacrylates or derivatives or thickeners based on polysaccharides, e.g. xanthan gum, than expected, as thickening of such a concentrated composition with a high electrolyte content was thought to be particularly difficult. Surprisingly, there was no such effect observed with the aqueous composition of the present invention.

It is preferred that the packaged aqueous liquid detergent composition in its uncoloured form is a translucent or transparent liquid or gel having a transmission ratio of more than 30%, preferably more than 40%, most preferably more than 50%, measured in accordance with the ELVORS transmission method.

In a preferred form the water-soluble or water-dispersible packaging material is in the form of a film or a moulding (especially injection moulding), selected from the group consisting of poly(vinylalcohol) based homopolymers, copolymers or graft polymers, polyethylene oxide and cellulose derivatives.

In a preferred embodiment the packaged aqueous liquid detergent composition is a dishwashing, rinse-aid, water-softening or laundry washing composition, the product being preferably suitable for use in a domestic dishwashing or laundry machine.

The packaging (containers or sachets) made of water-soluble or water-dispersible material can be manufactured and filled by any appropriate method, for example thermoforming the film material to form a pocket, filling the pocket with the inventive aqueous composition and sealing the pocket with the same or a different film material. Sealing can be done by heat sealing across the flange of the pocket. Other methods of sealing may be used, for example, infra-red, radio frequency, ultrasonic, laser, solvent, vibration or spin welding. An adhesive, such as water or an aqueous solution of the film material, may also be used. There are also other methods of manufacturing the containers such as injection moulding, as disclosed, for example, in WO 01/36290. More details on manufacturing processes for the containers can be seen from the prior art such as CA-A-1,112,534.

Further details and advantages of the invention can be seen from the following examples.

EXAMPLES

Example 1

The following formulations were prepared by mixing together the indicated components in the weight proportions indicated to prepare a heavy duty dishwasher liquid.

| Formulation 1 | |
|---|---|
| Amylase (Genencor) | 0.3% |
| Properase (Genencor) | 0.6% |
| Sorbitol (70% aqueous solution) (ADM) | 10% |
| Potassium Tripolyphosphate (Rhodia) | 50% |
| Xanthan Gum (ADM) | 7% |
| Dehardened water | 38.2% |
| Blue Dye (Clariant) | 0.0025% |
| Perfume (Givaudan) | 0.3% |

| Formulation 2 | |
|---|---|
| Amylase (Termamyl) | 0.35% |
| Protease (Properase 4000D) | 0.64% |
| Sorbitol | 19% |
| KTTP | 41% |
| Water | 29.5% |
| Dye + Perfume + acid + Preservative | 0.511% |
| Polyacrylic Acid | 0.85% |
| Sulphonated Polymer (Acusol 588) | 2.28% |

| Formulation 3 | |
|---|---|
| Amylase (Termamyl) | 0.35% |
| Protease (Properase 4000D) | 0.64% |
| Saccharose | 19% |
| KTTP | 41% |
| Water | 27.46% |
| Dye + Perfume + acid + Preservative | 0.511% |
| Polyacrylic Acid | 0.85% |
| Sulphonated Polymer (Acusol 588) | 1.58% |

| Formulation 4 | |
|---|---|
| Amylase (Termamyl) | 0.35% |
| Protease (Properase 4000D) | 0.64% |
| Saccharose | 19% |
| KTTP | 41% |
| Water | 27.46% |

-continued

| Formulation 4 | |
|---|---|
| Dye + Perfume + acid + Preservative | 0.511% |
| Polyacrylic Acid | 0.85% |
| Sulphonated Polymer (Acusol 588) | 1.58% |

Both saccharose and sorbitol were stable in the above listed Formulations. The viscosity in all the formulations is about 12000 cps (at 25° C., Sp.27) even with the inclusion of the polymers.

The compositions (25.3 g) was filled into a container using the following procedure.

A Multivac thermoforming machine operating at 6 cycles/min and at ambient conditions of 25° C. and 35% RH (±5% RH) was used to thermoform an anhydrous PVOH film. The PVOH film was prepared by a blown process from granules provided by PVAXX (RTM) ref C120 having a degree of hydrolysis of 88% and a thickness of 110 μm. When formed the PVOH has a negligible water content. The PVOH film was wrapped in a sealed polyethylene container which remained sealed until immediately prior to use. The PVOH film was thermoformed into a rectangular mould of 39 mm length, 29 mm width and 16 mm depth, with the bottom edges being rounded to a radius of 10 mm, at 125-148° C. The thus formed pocket was filled with 17 ml of the composition, an identical film was placed on top and heat sealed at 154-162° C. The thus produced containers were separated from each other by cutting the flanges. Each container was rounded and had a full appearance. After a few hours they attained an even more attractive, rounded appearance.

Comparative Example 1

The following formulation was prepared by mixing together the indicated components in the weight proportions indicated to prepare a heavy duty dishwasher liquid.

| | |
|---|---|
| Amylase (Termamyl) | 0.35% |
| Protease (Properase 4000D) | 0.64% |
| Potassium tripolyphosphate | 12% |
| Sodium tripolyphosphate | 30% |
| Isothiazolinone | 0.1% |
| Polyacrylate thickener (Carbopol) | 1% |
| Nonionic surfactant | 0.5% |
| Sodium citrate | 10% |
| Dehardened water | 46.4% |

The composition (26.8 g) was filled into a container using the same procedure as for the Formulations in accordance with the invention.

Performance Examples

1) Cleaning Performance

The performance of the compositions was tested according to IKW method (IKW-Arbeitskreis Maschinenspülmittel, "Methoden zur Bestimmung der Reinigungsleistung von maschinellen Geschirrspülmitteln (Part A and B)", SÖFW, 11+14, 1998).

The cleaning of an Formulation in accordance with the invention (Example 1—Formulation 2) was compared to the performance of the formulation of Comparative Example 1.

Cleaning was tested in a Bosch SMS 5062 dishwashing machine using a 55° C. cycle. In each case a pouch comprising the formulation was added at the start of the dishwasher main wash cycle. The water hardness was 21° gH. The results (given in Tables 1 and 2) are expressed in accordance with the IKW performance measurements; for bleaching, starch, protein and burnt on stains on a scale of 0-10 with 0 being the worst and 10 being the best; and for spotting and filming on a scale of 0-5 with 0 being the best and 5 being the worst.

TABLE 1

| | Formulation | |
|---|---|---|
| | Example 1 Formulation 1 | Comparative Example 1 |
| Bleachable Stains | 4.5 | 4.2 |
| Starch, dried on | 9.4 | 9.4 |
| Protein, dried on | 8.5 | 8.8 |
| Burnt-on stains | 7.8 | 8.2 |
| Average | 7.6 | 7.6 |

TABLE 2

| | Formulation | |
|---|---|---|
| | Example 1 Formulation 1 | Comparative Example 1 |
| Spotting | 2.0 | 2.0 |
| Filming | 1.8 | 2.4 |

The performance of the formulation in accordance with the invention either equals or betters that of the comparative Example, even though a smaller amount of the inventive composition is used.

2) Stability Performance

The stability of the compositions was tested by storing the compositions in a controlled environment (40° C. and 75% relative humidity) over a prolonged period.

During this time the compositions were examined visually for stability of the gel and crystal formation. These results are shown in Table 3.

TABLE 3

| | Formulation | |
|---|---|---|
| | Comparative Example 1 | Example 1—Formulation 1 |
| 1 month | no solidification/ crystallisation | no solidification/ crystallisation |
| 2 months | no solidification/ crystallisation | no solidification/ crystallisation |
| 3 months | no solidification/ crystallisation | no solidification/ crystallisation |
| 4 months | first visible crystals/ solid particles in the matrix | no solidification/ crystallisation. Gel properties prevail |
| 5 months | strong precipitation of solid particles. Formulation lost its gel characteristics | no solidification/ crystallisation. Gel properties prevail. |

The formulation in accordance with the invention shows much greater stability and considerable lower tendency for solidification/crystal formation.

The invention claimed is:

1. A package comprising an aqueous liquid detergent composition enclosed by a water-soluble or water-dispersible packaging material, said aqueous liquid detergent composition having a water content of between 20 and 50 wt %, and comprising at least one polyphosphate builder material, in an amount of greater than 20 wt % and from 10% to 40 wt % sorbitol.

2. A package according to claim 1, wherein the amount of sorbitol in the composition is up to 35 wt %.

3. A package according to claim 1, wherein the amount of sorbitol in the composition is up to 30 wt %.

4. A package according to claim 1, wherein the amount of polyphosphate builder in the composition is preferably up to 70 wt %.

5. A package according to claim 1, wherein the water content of the composition is between 20 and 40 wt %.

6. A package according to claim 1, wherein the aqueous liquid detergent composition comprises up to 15 % by weight of a sulphonated polymer.

7. A package according to claim 6, wherein the sulphonated polymer is a co-polymer.

8. A package according to claim 7, wherein the copolymer comprises:

(I) 50-90% by weight of one or monoethylenically unsaturated $C_3$-$C_6$ monocarboxylic acid;

(II) 10-50% by weight of unsaturated sulphonic acid.

9. A package according to claim 8, wherein the monoethylenically unsaturated $C_3$-$C_6$ monocarboxylic acid is (meth) acrylic acid.

10. A package according to claim 8, wherein the unsaturated sulphonic acid monomer is 2-acrylamido methyl-1-propanesulphonic acid.

11. A package according to claim 1, wherein the detergent composition comprises a oligocarboxylate or polycarboxylate builder.

12. A package according to claim 4 wherein the amount of polyphosphate builder in the composition is preferably up to 60 wt%.

* * * * *